US006557699B1

(12) United States Patent
Focke et al.

(10) Patent No.: US 6,557,699 B1
(45) Date of Patent: May 6, 2003

(54) CIGARETTE PACKET WITH AUXILIARY OPENING MEANS

(75) Inventors: Heinz Focke, Verden (DE); Dieter Neuber, Upper Saddle River, NJ (US)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/743,407

(22) PCT Filed: Jul. 6, 1999

(86) PCT No.: PCT/EP99/04669

§ 371 (c)(1),
(2), (4) Date: Jan. 10, 2001

(87) PCT Pub. No.: WO00/03937

PCT Pub. Date: Jan. 27, 2000

(30) Foreign Application Priority Data

Jul. 15, 1998 (DE) ..... 198 31 621

(51) Int. Cl.[7] ..... B65D 85/10; B31B 1/26; B65B 43/10

(52) U.S. Cl. ..... 206/264; 53/456; 53/463; 229/160.1; 493/79

(58) Field of Search ..... 206/254, 264, 206/271, 273; 229/160.1, 240; 493/79; 53/456, 463

(56) References Cited

U.S. PATENT DOCUMENTS

| | | | | | |
|---|---|---|---|---|---|
| 2,026,477 | A | * | 12/1935 | Lescher | 206/264 |
| 2,688,434 | A | * | 9/1954 | Udel | 206/264 |
| 2,822,120 | A | | 2/1958 | Tamarin | |
| 2,844,298 | A | | 7/1958 | Tamarin | |
| 3,166,233 | A | | 1/1965 | Cutler et al. | |
| 3,276,668 | A | * | 10/1966 | Tamarin | 206/264 |
| 4,015,770 | A | | 4/1977 | Tamarin | |
| 4,465,185 | A | | 8/1984 | Sur | |
| 5,052,993 | A | * | 10/1991 | Focke | 493/79 |
| 5,151,073 | A | * | 9/1992 | Focke | 493/79 |
| 5,762,186 | A | | 6/1998 | Bretthauer | |
| 5,819,924 | A | * | 10/1998 | Sigrist et al. | 206/264 |
| 6,244,435 | B1 | * | 6/2001 | Cho | 206/264 |

FOREIGN PATENT DOCUMENTS

| | | |
|---|---|---|
| DE | 634 802 | 4/1935 |
| DE | 1 956 569 | 10/1966 |
| DE | 31 24 118 | 2/1983 |
| DE | 198 02 800 | 7/1999 |
| WO | 96 36 538 A3 | 11/1996 |
| WO | 96 36 538 A2 | 11/1996 |

* cited by examiner

*Primary Examiner*—Bryon P. Gehman
(74) *Attorney, Agent, or Firm*—Sughrue Mion, PLLC

(57) ABSTRACT

Pack, in particular cigarette pack of the soft pack type, with a pack container made of tearable material surrounding the contents of the pack and forming an end wall (17) from folding flaps, an opening tab (39) delimited by perforation lines (38) and/or punched lines (40) being defined in the region of the end wall. The opening tab (39) is connected to an outer wrapping (33) made of foil in such a manner that the opening tab (39) moves into an opening position or is removed when the outer wrapping (33) is opened or removed.

2 Claims, 5 Drawing Sheets

Figure 2:
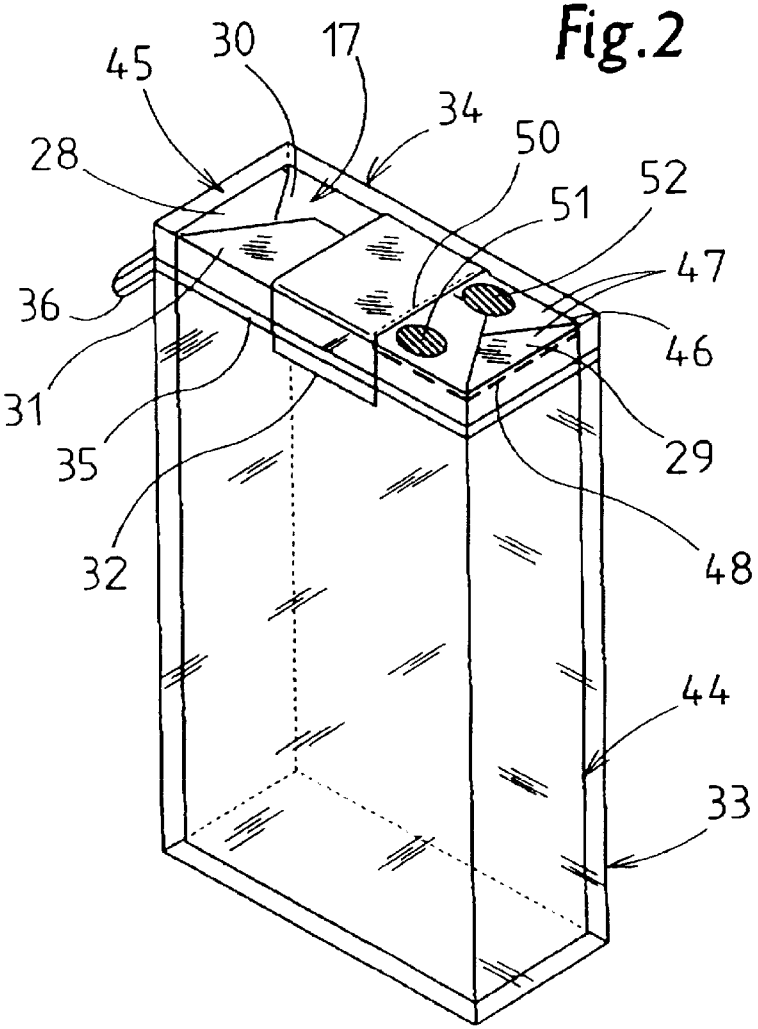

52
47
46
29
48
44
33
51
50
34
17
30
45
28
36
31
35
32

17
43
41
13
11
33
37
29
35
38
12
15
16
42
32
30
34
39
28
36
31
24
14

43
24
23
15
18
20
41
25
22
19
25
22/23
18/19
26
24
42
13
38
20
41
15
43
42
12
39
14
24
40

CIGARETTE PACKET WITH AUXILIARY OPENING MEANS

DESCRIPTION

The invention relates to a pack, in particular a cigarette pack, consisting of at least one pack container surrounding the contents of the pack, preferably of the soft pack type, and an outer wrapping made of foil or the like which, when the pack is taken into use, is at least partly removed, the pack container having a tear-open or opening tab delimited by folding and/or by weakening lines.

In packs for goods of mass consumption, in particular in cigarette packs, the problem exists of easy opening of the pack, which is simple for the consumer to perform, when the pack is (first) taken into use. In cigarette packs of the soft pack type in particular, it is usual, in the region of one end wall of an inner wrapping made of tin foil, to tear out a part region of the end wall carefully by hand and in this way to fashion a removal opening. Attempts have already been made, with the aid of perforation lines, to produce an opening tab which is easier to remove, but this still allows only unsatisfactory handling.

The object of the invention is therefore to make the opening of a pack, in particular a cigarette pack, easier when first taken into use.

To achieve this object, the pack according to the invention is characterized in that the opening tab of the pack container is connected to the outer wrapping in such a manner that, when the outer wrapping is removed, the tear-open tab can be moved into an opening position or separated from the pack container.

Accordingly, the inventive idea consists in the opening tab of a pack, in particular an opening tab defined by perforations or in another manner, being automatically removed or at least moved into an opening position, when the outer wrapping is removed. To this end, the opening tab, but if appropriate the top of a pack also, is connected by gluing to the outer wrapping made of foil or to that part of the outer wrapping to be removed. Accordingly, when the outer wrapping is completely or partly removed when the pack is first taken into use, this brings about automatic opening of the tab.

In a soft pack, one end wall consists of tearable material, that is to say of tin foil (inner wrapping of a conventional soft pack) or of paper (pack according to U.S. Pat. No. 5,762,186). The end wall of the inner wrapping or of the pack container is provided with an opening tab defined by perforations and/or punched lines. This tab is fastened by means of glue to the inside of one end wall of the outer wrapping made of foil. Usually, an upper part of the outer wrapping, that is to say a top part, is removed with the aid of a tear-open strip which runs all the way round. The opening tab is connected to this top part. When the top part is taken hold of, the opening tab is pulled into the opening position while remaining connections are broken.

The invention can be used especially advantageously in a pack with an opening aid according to DE 198 02 800.8.

Figure 1:
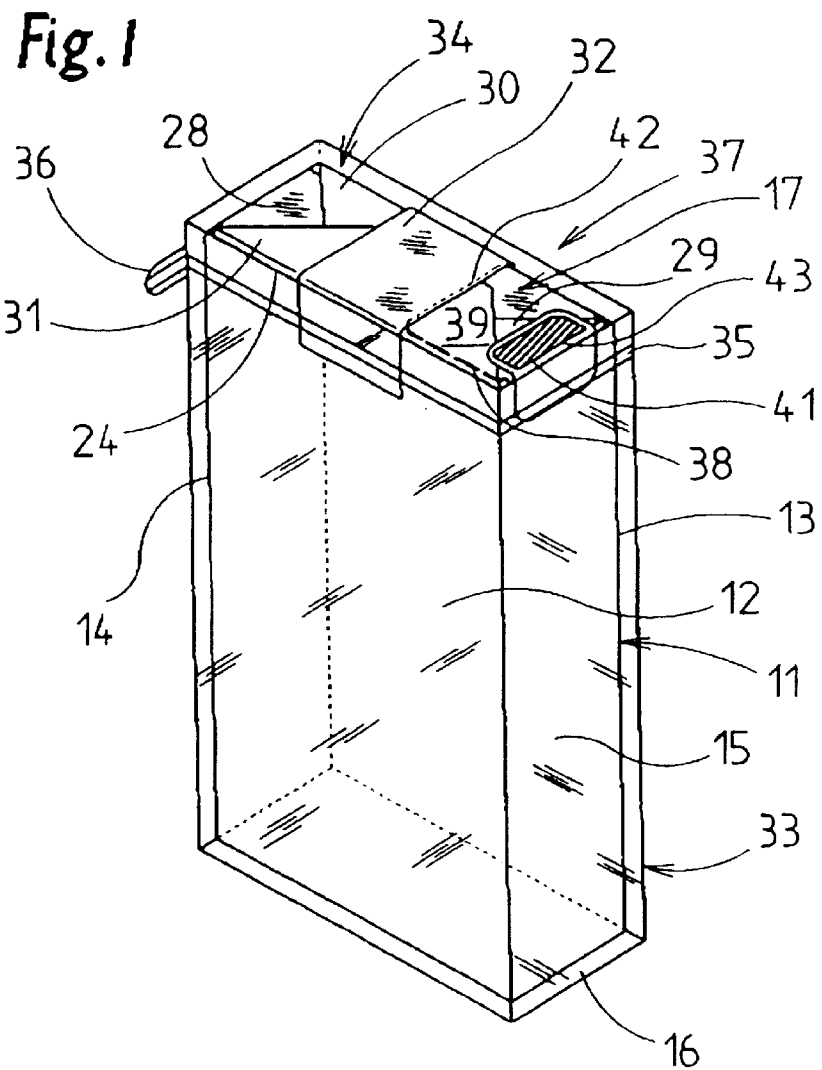
Figure 4:
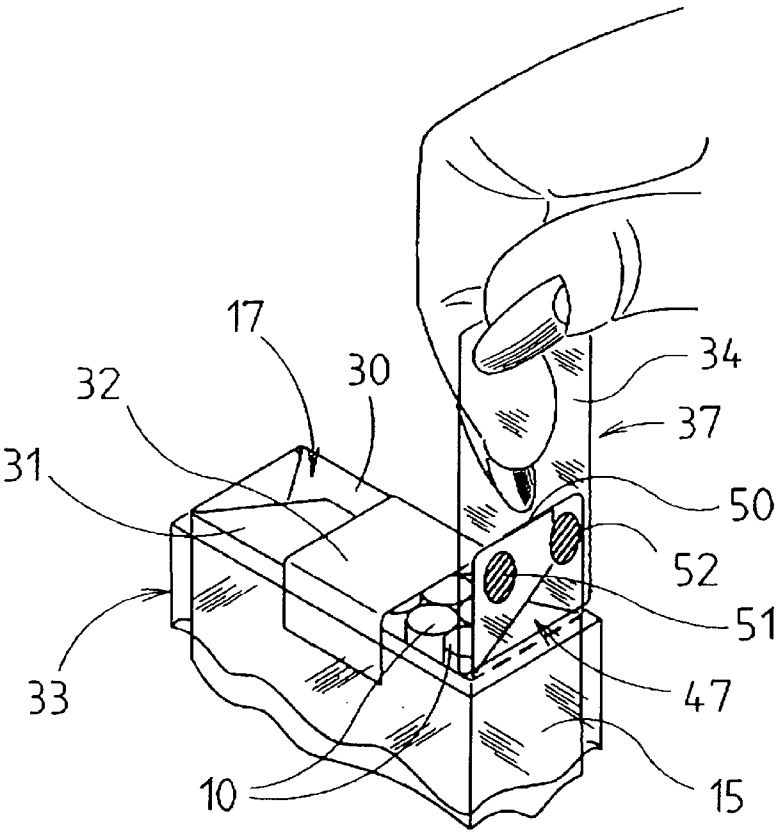
Figure 3:
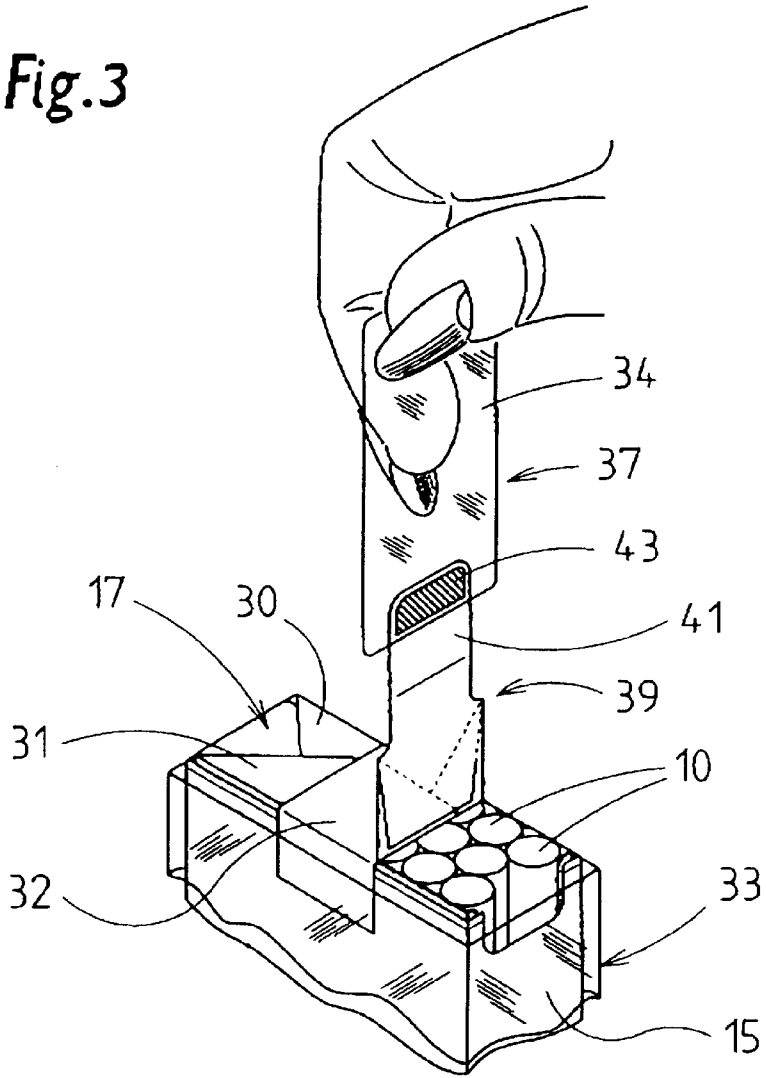
Figure 5:
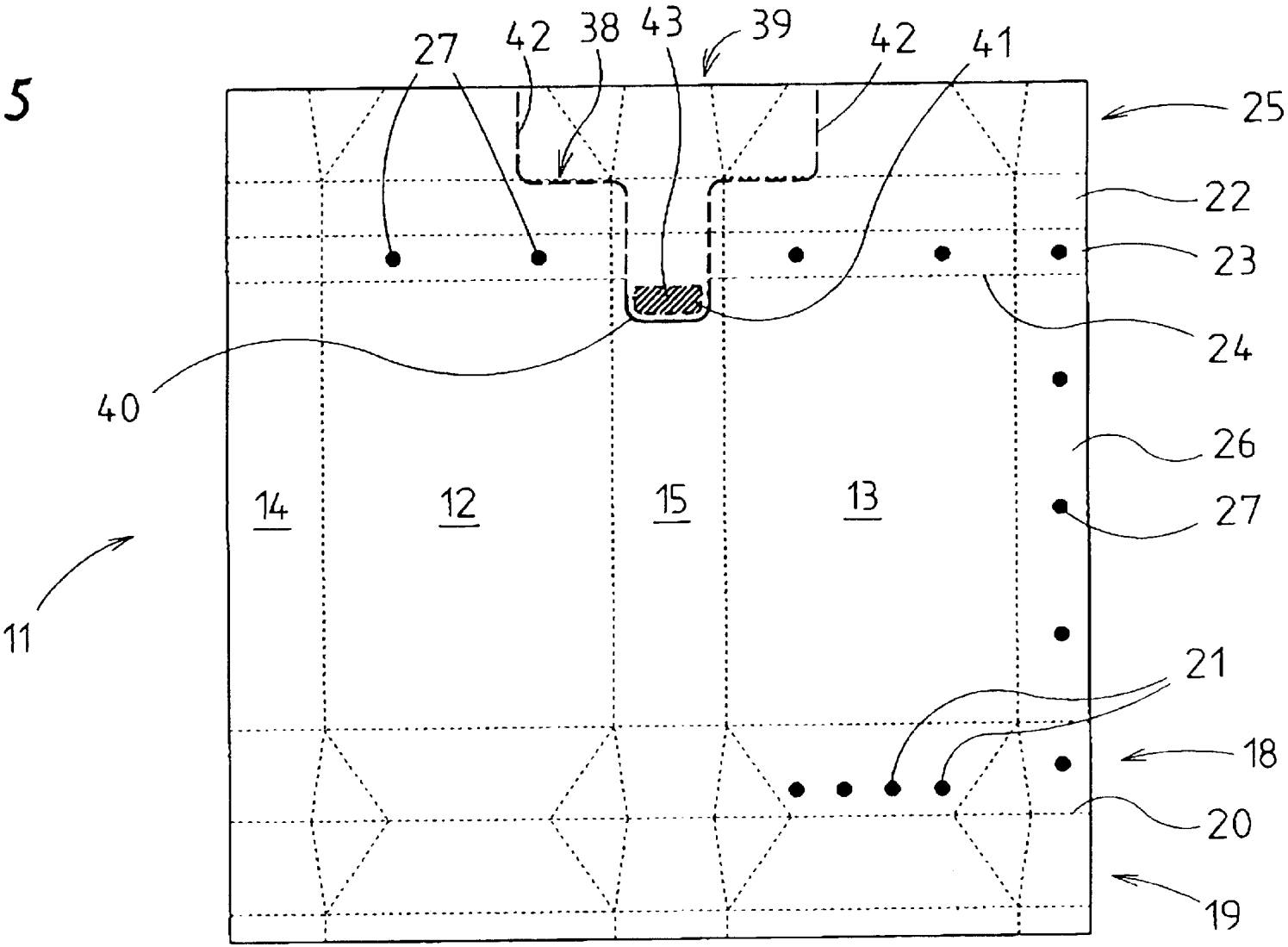
Figures 6, 7:
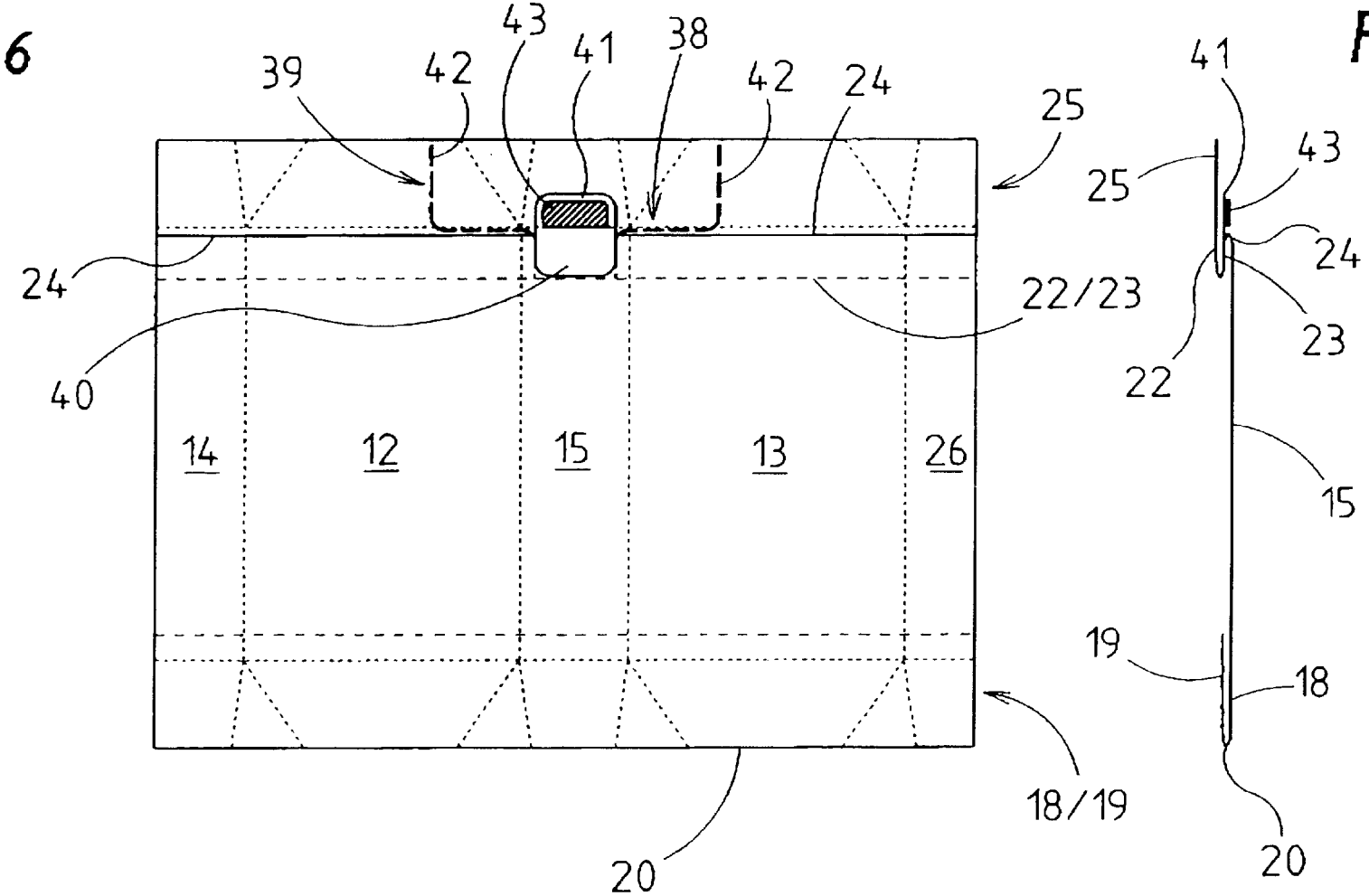
Figure 8:
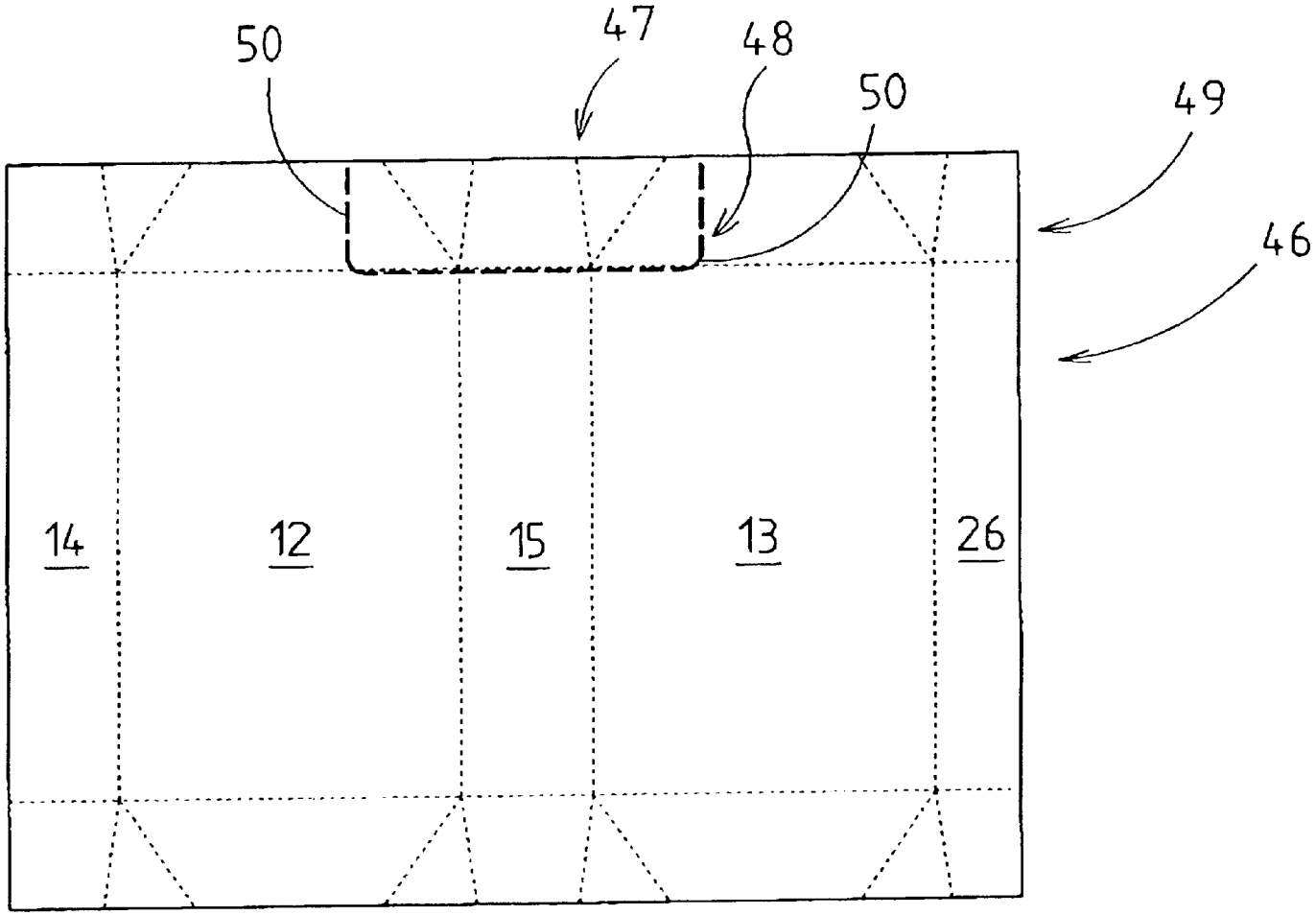

Further details and features of the pack according to the invention are described below with reference to the drawings, in which:

FIG. 1 shows a cigarette pack of the soft pack type in a perspective illustration, FIG. 2 shows a different embodiment of a soft cigarette pack, likewise in a perspective illustration, FIG. 3 shows a stage during the opening of a pack according to FIG. 1 in a perspective illustration, FIG. 4 shows an illustration similar to FIG. 3 for the exemplary embodiment in FIG. 2, FIG. 5 shows a spread-out blank for a pack container of a pack according to FIG. 1 and FIG. 3, FIG. 6 shows the blank according to FIG. 5 in an intermediate folded position, FIG. 7 shows the blank in the folded position according to FIG. 6 in cross section, and FIG. 8 shows a spread-out blank for an inner wrapping of a pack according to FIG. 2 and FIG. 4.

Cigarette packs and their blanks are shown in the drawings as preferred exemplary embodiments. The packs are those in which the contents of the pack, that is to say a group of cigarettes 10, are completely surrounded by a blank made of tearable packaging material.

FIG. 1 shows a modified soft pack. This consists of a single blank (FIG. 5) for forming a pack container 11 with a front wall 12, rear wall 13, two narrow, upright side walls 14, 15, a bottom wall 16 and an end wall 17. A special feature of this pack container 11 is the twin-ply design of the bottom wall 16. To this end, the blank according to FIG. 5 has two folding strips 18, 19 on the bottom side. The lower or marginal folding strip 19 is folded over against the folding strip 18 (FIG. 6, FIG. 7) alone a folding edge 20 so that this marginal region of the blank is of twin-ply design. In this twin-ply region, the bottom wall 16 is formed by conventional envelope folding. In this connection, an outer, trapezoidal (twin-ply) folding flap is fixed in the folded position by glue, in the present case by (four) glue spots 21. The outer appearance of the bottom wall 16 corresponds to that of a conventional soft pack.

The blank according to FIG. 5 or the cigarette pack according to FIG. 1 is specially formed in the region of the end wall 17 also. Two material strips 22, 23 of the blank are folded in a Z-shaped manner, in particular on the inside of the pack container 11 to be produced. A fold line 24 then forms an upper margin which creates the impression optically of a marginal edge of a conventional soft pack. Adjoining the material strip 22 is an end wall strip 25 which is folded in the conventional manner to form the end wall 17.

The end wall 17 is designed in the same way as the end wall of an inner wrapping, consisting of tin foil for example, of a conventional soft pack. The blank according to FIG. 5 is to this end first folded into an intermediate folded position according to FIG. 6 and FIG. 7 with the Z-fold described adjacent to the end wall 17 or end wall strip 25. Then, a tubular, cross-sectionally closed intermediate folded position of the blank is brought about, an internal marginal flap 26 being connected by glue spots 27 to the associated side wall 14 on the free margin of the blank. After the bottom wall 16 has been folded and the pack finished thus far has been filled, the end wall is folded in the conventional manner so that internal corner flaps 28, 29 and trapezoidal longitudinal flaps 30, 31 folded onto these are formed. A seal 32, for example a revenue stamp, extends transversely across the end wall 17.

The pack or pack container 11 described thus far is in other respects expediently designed as illustrated and described in U.S. Pat. No. 5,762,186.

The pack container 11 is completely surrounded by an outer wrapping 33 made of thin foil, in particular a transparent foil. The outer wrapping 33 can be folded in various ways. It is usual to design the region of one outer end wall 34 with a folded construction according to the end wall 17.

When the pack is first taken into use, the outer wrapping 33 is completely or partly removed. In the present exemplary embodiments, the outer wrapping 33 is provided with a tear-open strip 35. This has a grip end 36 which can be taken hold of. By actuating the tear-open strip 35, an upper part region of the outer wrapping 33, that is to say a top part 37, is separated and removed.

The pack is provided with an automatic opening aid. In the exemplary embodiment in FIGS. 1, 3, 5, 6 and 7, this is formed using the Z-fold. The blank according to FIG. 5 is provided with a weakening line, that is to say a perforation line 38, which, when the blank is unfolded, delimits a T-shaped marginal opening tab 39. This extends with a part region within the side wall 15, moreover in the region of the Z-fold, in other words of the material strips 22, 23, and also in the region of the end wall strip 25. In one end region, which projects into the side wall 15, the opening tab 39 is provided with a continuous punched line 40 as a delimitation. Accordingly, the tear-open or opening tab 39 is not connected to the remaining part of the blank in this region.

On account of the manner in which the opening tab 39 is arranged and formed, when the material strips 22, 23 are folded on the Z-shaped manner, an erected, freely projecting position results for the grip tab 41 delimited by the punched line 40. This tab extends in prolongation of the side wall 15 beyond the fold line 24 formed when the Z-fold is made. When the pack or pack container 11 is completed, inter alia by folding the end wall 17, the grip tab 41 is folded over into the plane of the end wall 17. The grip tab 41 lies on top of the end wall 17 on the outside, that is to say in each case with part regions on the corner flaps 29 and the longitudinal flaps 30, 31 (FIG. 1). In other respects, the pack is designed according to DE 198 02 800.8 with regard to the opening aid. This means that, in the lateral region of the end wall 17, that is to say in a region next to the seal 32, an opening tab 39 is defined, which can be removed completely, that is to say torn out. When the grip tab 41 is actuated, the opening tab 39 is torn out along the perforation line 38 as far as the seal 32 or to slightly below the seal 32, perforation branches 42 acting as transversely directed separating lines in the region of the longitudinal flaps 30, 31.

The opening tab 39 is connected to the inside of the outer wrapping 33, that is to say to its outer end wall 34. Glue is used for the connection. The outwardly or upwardly facing side of the grip tab 41 is provided with a glued surface 43 which connects the grip tab 41 as part of the opening tab 39 to the outer wrapping 33, that is to say to the outer end wall 34. Transparent glue is expediently used, so that the glued surface 43 is not outwardly visible.

When the pack designed in this way is opened, the outer wrapping 33 or the top part 37 is removed by actuating the tear-open strip 35. By taking hold of and raising the top part 37, the opening tab 39 is actuated, on account of the connection to the grip tab 41, and torn out of the end wall 17 along the perforation line 38.

After exposes a removal opening for the cigarettes 10, the opening tab 39 can remain connected to the pack container 11. In the present exemplary embodiment, however, the opening tab 39 is removed completely together with the top part 37 as a result of the action of the perforation branch 42.

The manufacture of a pack provided with such an automatic opening aid is carried out in a special manner. The glued surface 43 can be applied (on the inside) to the outer wrapping 33 before the latter is folded completely around the pack container 11. The present exemplary embodiment is designed in such a manner that the glued surface 43 is applied to the blank, in particular, and advantageously, during the manufacture of a material web for blanks according to FIG. 5. The blanks are usually supplied ready-printed by a manufacturer of packaging material. In this process, the glued surface 43 is applied according to the proposal shown in a positionally appropriate manner and, in fact, on the unprinted, inner side because of the special folding system of the opening tab or grip tab 41 shown here. In this respect, use is made of a glue which sets after application to the blank or to the material web and, at a later time, that is to say after complete finishing of the pack according to FIG. 1, is reactivated by heat and pressure to make the connection to the outer wrapping 33. Glue of the hot-melt type is suitable.

The connection of the glued surface 43 to the inside of the folded outer end wall 34 is expediently made during the connection of the folding tabs of this outer end wall 34 by thermal sealing. The pressure applied and the heat bring about simultaneously the connection of the grip tab 41 to the outer end wall 34.

The automatic opening aid can also be used in other, comparable packs. FIG. 2 shows a fundamentally conventional cigarette pack of the soft pack type. A pack container 44 is designed as a container open at the top. Arranged inside this is a cigarette block 45 which consists of an inner wrapping 46 made of tin foil, paper or the like surrounding the group of cigarettes 10. The inner wrapping 46 is folded in such a manner in the upper region that an end wall 17 corresponding to the exemplary embodiment in FIG. 1 is formed. The folding flaps of the end wall 17 are in this case also held in the closed position by a seal 32.

An opening tab 47 is provided as an opening aid in the lateral region of the end wall 17 next to the seal 32.

FIG. 8 shows an unfolded blank for the inner wrapping 46. The opening tab 47 is formed by a U-shaped perforation line 48 in the region of an end wall strip 49. The U-shaped perforation line 48 extends along the delimitation of the side wall 15, the front wall 12 and the rear wall 13. Transversely directed perforation branches 50 run transversely to the end wall 17 in the region of the longitudinal flaps 30, 31, in a similar manner to the exemplary embodiment according to FIG. 1.

The soft pack designed in this way is surrounded by an outer wrapping 33 of the type described. The opening tab 47 is connected to the outer end wall 34 of the same, in particular by (two) glue spots or glued surfaces 51, 52. These are arranged on the end wall 17, that is to say in the region of the longitudinal tabs 30, 31. When the pack according to FIG. 2 is (first) opened with the aid of the tear-open strip 35, the top part 37 is freed and can be removed by hand. At the same time, the opening tab 47 is torn out of the end wall 17. For easier tearing out (FIG. 4), that part of the opening tab 47 taken hold of first during the opening operation, that is to say the perforation branch 50, can be designed completely or partly as a punched line.

The glued surfaces 51, 52 can be applied in various ways. For example, the glued surfaces 51, 52 can be applied in a positionally appropriate manner during manufacture of a material web for the inner wrapping 46. It is also possible for the finished blanks according to FIG. 8 to be provided with glued surfaces 51, 52. In the present embodiment, however, it is particularly advantageous to apply the glued surfaces 51, 52 to the end wall 17 in the region of the opening tab 47 after the pack itself is finished but before the outer wrapping 33 is put on, and to activate them in the manner described when the outer wrapping 33 is finished. Lastly, it is also possible, however, to provide the outer wrapping 33 itself with glue.

What is claimed is:

1. A method for manufacturing a pack comprising: a pack container (11) which directly surrounds contents of the pack, an inner wrapping (46), and an outer wrapping (33) which is made of film and which is at least partially removed when the pack is first used, the pack container (11) and inner wrapping (46) having in the region of a pack end wall (17) an opening tab (39) which is delimited by weakening lines and which is connected to the outer wrapping (33) in such a manner that, when the outer wrapping (33) is removed, the opening tab (39) is severed from the inner wrapping, said method being characterized in that:

a) blanks for the pack container (11) or inner wrapping (46) are severed from a continuous material web;

b) before the blanks for the pack container (11) or the inner wrapping (46) are severed, the material web is provided with glue surfaces (43, 51, 52) for each blank;

c) the glue surfaces (43, 51, 52) are arranged so that, in a completely folded pack container (11) or inner wrapping (46), the glue surfaces are positioned in a region of the opening tab (39) of the pack end wall (17) at an outer side thereof;

d) the material web is furthermore provided, in the region of every blank, with a continuous perforation line (38, 48) for delimiting an opening tab (47) which can be completely torn out of the end wall (17);

e) the glue surfaces (43, 51, 52) applied to the material web consist of glue which can set after application and which can be reactivated by heat and pressure;

f) after being severed from the material web, each blank is folded around the pack contents to form the pack container (11) or the inner wrapping (46), g) the outer wrapping (33) is then folded around the pack thus configured to form folding tabs in the region of an outer wrapper end wall (34) which covers the pack end wall (17); and h) the folding tabs of the outer wrapper end wall (34) are then connected to each other by means of thermal sealing through the application of heat and pressure, with the heat and pressure being chosen such that the glue surfaces (43, 51, 52) are reactivated so that the pack end wall (17) is connected to the outer wrapping end wall (34);

said method being further characterized in that, for the production of pack containers (11) with a Z-fold made from material strips (22, 23) folded in a Z-shape adjacent to the pack end wall (17), a grip tab (41) is connected to the opening tab (39) and extends into the region of an adjacent pack side wall (15) with a freely-projecting portion being folded against the pack end wall (17) in the region of the opening tab (39), one of the glue surfaces (43) being applied to a non-printed inner side of the material web for connecting the grip tab (41) to the outer wrapping (33).

2. A pack comprising at least one pack container (11) surrounding contents of the pack, and an outer wrapping (33) which is made of film and which can be at least partially removed when the pack is used for the first time, the pack container (11) having in the region of a pack end wall (17) an opening tab (39) delimited by weakening lines and connected to the outer wrapping (33) in such a manner that, when the outer wrapping (33) is removed, the opening tab (39) can be separated from the pack container (11), said pack being characterized by the following features:

a) the pack container (11) or a blank for the formation of the container has a Z-fold made from material strips (22, 23) folded in a Z-shape adjacent to the end wall (17), b) the opening tab (39) is connected to a grip tab (41), which extends in the region of the Z-fold or of the material strips (22, 23) and continues in the region of an adjacent pack side wall (15), c) the grip tab (41) has a freely-projecting portion defined by a perforation line (40) and folded against the pack end wall (17) in the region of the opening tab (39), and d) in the region of the freely-projecting portion, the grip tab is connected to the outer wrapping (33).

* * * * *